US011753215B2

(12) United States Patent
Oomori et al.

(10) Patent No.: US 11,753,215 B2
(45) Date of Patent: Sep. 12, 2023

(54) CONTAINER CLOSURE OF SYNTHETIC RESIN

(71) Applicant: NIPPON CLOSURES CO., LTD., Tokyo (JP)

(72) Inventors: Shinji Oomori, Kanagawa (JP); Takashi Sugiyama, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 178 days.

(21) Appl. No.: 17/427,838

(22) PCT Filed: Feb. 10, 2020

(86) PCT No.: PCT/JP2020/005069
§ 371 (c)(1),
(2) Date: Aug. 2, 2021

(87) PCT Pub. No.: WO2020/166547
PCT Pub. Date: Aug. 20, 2020

(65) Prior Publication Data

US 2022/0127048 A1 Apr. 28, 2022

(30) Foreign Application Priority Data

Feb. 15, 2019 (JP) ..... 2019-025644

(51) Int. Cl.
*B65D 41/34* (2006.01)
*B65D 55/16* (2006.01)

(52) U.S. Cl.
CPC ..... *B65D 41/3423* (2013.01); *B65D 55/16* (2013.01); *B65D 2401/30* (2020.05)

(58) Field of Classification Search
CPC . B65D 41/3423; B65D 55/16; B65D 2401/30
(Continued)

(56) References Cited

U.S. PATENT DOCUMENTS 10,654,625 B2 * 5/2020 Migas ..... B65D 1/0246
11,485,550 B2 * 11/2022 Naumann ..... B65D 55/16
(Continued)

FOREIGN PATENT DOCUMENTS

CN 102695657 9/2012
EP 1529736 A2 * 5/2005 ..... B65D 41/3452
(Continued)

OTHER PUBLICATIONS

Notice of Reasons for Refusal dated Sep. 1, 2022 in Japanese Patent Application No. 2019-025644, with English-language translation.
(Continued)

*Primary Examiner* — J. Gregory Pickett
*Assistant Examiner* — Niki M Eloshway
(74) *Attorney, Agent, or Firm* — WENDEROTH, LIND & PONACK, L.L.P.

(57) ABSTRACT

A container closure of synthetic resin is for a container having a mouth-and-neck portion with an external thread on an outer periphery thereof and an engaging jaw portion positioned below the external thread. The container closure includes a body and a tamper evident skirt portion, and is configured to not be entirely separated from the mouth-and-neck portion of the container even after unsealing the container at the mouth-and-neck portion. At least in an angle region in which a protruding piece on a skirt wall of the body is present, an extending portion is defined at an engaging piece on the tamper evident skirt portion. When the container closure is mounted on the mouth-and-neck portion of the container, the extending portion of the container closure is positioned between the engaging jaw portion of the mouth-and-neck portion of the container and the tamper evident skirt portion of the container closure.

9 Claims, 4 Drawing Sheets

(58) Field of Classification Search
USPC ..... 215/252
See application file for complete search history.

(56) References Cited

U.S. PATENT DOCUMENTS

| | | | | |
|---|---|---|---|---|
| 11,518,592 | B2 * | 12/2022 | Bassi | B65D 41/325 |
| 2008/0173611 | A1 * | 7/2008 | Neputy | B65D 41/3423 215/256 |
| 2010/0032402 | A1 | 2/2010 | Widmer et al. | |
| 2011/0114593 | A1 | 5/2011 | Ishii et al. | |
| 2012/0285921 | A1 | 11/2012 | Kwon | |
| 2012/0298666 | A1 * | 11/2012 | Kwon | B29C 45/44 220/268 |
| 2018/0118418 | A1 | 5/2018 | Nakamura | |
| 2022/0073238 | A1 * | 3/2022 | Naumann | B65D 47/0823 |

FOREIGN PATENT DOCUMENTS

| | | | | |
|---|---|---|---|---|
| JP | 2010-18290 | | 1/2010 | |
| JP | 2012-76771 | | 4/2012 | |
| JP | 2012076771 | A * | 4/2012 | |
| JP | 2013-203440 | | 10/2013 | |
| JP | 2014-31202 | | 2/2014 | |
| JP | 2014043246 | A * | 3/2014 | |
| JP | 60601357 | | 12/2016 | |
| TW | 201144171 | | 12/2011 | |
| WO | WO-2015173159 | A1 * | 11/2015 | B26F 1/0023 |
| WO | WO-2019177616 | A1 * | 9/2019 | B65D 41/3428 |
| WO | WO-2021068058 | A1 * | 4/2021 | B29C 45/26 |

OTHER PUBLICATIONS

Extended European Search Report dated Oct. 10, 2022 in European Patent Application No. 20756658.9.

Shan Hu et al., "A Human-centered Study of Open Process in Modern Container Design", Hubei Institute of Technology Academic Bulletin, Term 03, (Mar. 2010) pp. 99-103, With English abstract.

Chinese Office Action dated Nov. 18, 2022 in corresponding Chinese Patent Application No. 202080014484.9, with English translation.

International Search Report (ISR) dated Apr. 14, 2020 in International (PCT) Application No. PCT/JP2020/005069.

* cited by examiner

CONTAINER CLOSURE OF SYNTHETIC RESIN

TECHNICAL FIELD

The present invention relates to a container closure of synthetic resin, which can be applied to a container having an external thread formed on the outer periphery of its mouth-and-neck portion and an engaging jaw portion positioned below the external thread. Even after unsealing the mouth-and-neck portion of the container, the container closure is not completely separated from the mouth-and-neck portion of the container, so that the container closure is imparted with tamper evident properties.

BACKGROUND ART

Patent Documents 1-3 below each discloses a container closure of synthetic resin to be applied to a container that has an external thread formed on the outer periphery of its mouth-and-neck portion and an engaging jaw portion positioned below the external thread. The closure is composed of a body and a cylindrical tamper evident skirt portion. The body has a top panel wall and a cylindrical skirt wall extending perpendicularly downward from the peripheral edge of the top panel wall. On the inner periphery of the skirt wall, an internal thread to be screwed to the external thread on the mouth-and-neck portion is formed. The tamper evident skirt portion is connected to the skirt wall of the body via a plurality of breakable bridge portions disposed circumferentially with spacing, and the tamper evident skirt portion has an engaging means disposed on the inner periphery so as to engage with the engaging jaw portion. The engaging means is composed of a plurality of engaging pieces that are disposed circumferentially with spacing and extending upward and radially inward from the base end connected to the tamper evident skirt portion. Alternatively, the engaging means is composed of a single engaging piece present continuously in a circumferentially extended manner and extending upward and radially inward from the base end connected to the tamper evident skirt portion. Further, protruding pieces that protrude downward are disposed on the skirt wall of the body. On at least one of the circumferential side faces of each of the protruding pieces, an unbroken connecting piece is disposed. The unbroken connecting piece connects the skirt wall of the body and the tamper evident skirt portion, and allows the body to move to a position higher than the tamper evident skirt portion.

As mentioned above, in mounting the container closure on the mouth-and-neck portion of the container and sealing the mouth-and-neck portion, the container closure is fitted onto the mouth-and-neck portion and rotated in a closing direction so as to screw the internal thread of the container closure to the external thread of the mouth-and-neck portion. As the screwing proceeds, the container closure descends relative to the mouth-and-neck portion, and the engaging means formed at the tamper evident skirt portion passes elastically over the engaging jaw portion of the mouth-and-neck portion so as to be positioned below the mouth-and-neck portion. In unsealing the mouth-and-neck portion, the container closure is rotated in the opening direction to release the screwed external thread of the mouth-and-neck portion and the internal thread of the container closure. While the body of the container closure ascends relative to the mouth-and-neck portion along with the release of the screwing, the tamper evident skirt portion is inhibited from ascending because the engaging means engages with the engaging jaw portion of the mouth-and-neck portion, which causes stress applied to the breakable bridge portion, thereby breaking the breakable bridge portion. After the breakable bridge portion is broken, the body ascends continuously so that the body is distanced upward from the tamper evident skirt portion. Corresponding thereto, the unbroken connecting portion is deformed but it will not be broken, and the tamper evident skirt portion is still mounted on the mouth-and-neck portion. Even after the body is detached from the mouth-and-neck portion, the body is still connected to the tamper evident skirt portion via the unbroken connecting portion, and thus, the body is never separated from the mouth-and-neck portion of the container. After the body of the container closure is detached from the mouth-and-neck portion, the body of the container closure may be pivoted about a predetermined site of the unbroken connecting portion in the direction to be distanced from the mouth-and-neck portion. And when the body of the container closure is pivoted by more than a predetermined angle, the tip end of each of the protruding pieces formed on the skirt wall passes elastically over the engaging jaw portion of the mouth-and-neck portion so as to be positioned above the upper surface of the engaging jaw portion. This serves to inhibit the body from returning in the direction to approach the mouth-and-neck portion, and thus, the body is held at a position distanced from the mouth-and-neck portion to keep the mouth-and-neck portion in an unsealed state. When the tip end of the protruding piece passes elastically over the engaging jaw portion, the protruding piece is deformed elastically, and then, it restores elastically to generate a sound. Due to the sound, the consumer can recognize that the body of the container closure has been pivoted to the required opening position.

PRIOR ART DOCUMENTS

Patent Documents

Patent Document 1: JP-A-2010-18290
Patent Document 2: JP-A-2012-76771
Patent Document 3: JP-A-2014-31202

SUMMARY OF THE INVENTION

Problems to be Solved by the Invention

Recently, there has been a demand for light-weight packaging container from the viewpoint of environmental issues and cost reduction for materials. Similarly, there has been a demand for the container closure to be thinner and smaller in the axial direction. Under the circumstances, the present inventors have noticed from experience the following problem. A conventional container closure typically has a relatively short length in the axial direction in order to correspond to a mouth-and-neck portion that is relatively short in the axial direction (namely, the closure is relatively short in the vertical direction). When this container closure is used, the body detached from the mouth-and-neck portion for the purpose of unsealing the mouth-and-neck portion is pivoted in the direction to distance the body from the mouth-and-neck portion, whereby the tip end of the protruding piece passes elastically over the engaging jaw portion of the mouth-and-neck portion so as to be positioned above the engaging jaw portion. At this time, since the container closure is relatively short in the axial direction, the protruding length of the protruding piece is also decreased. As a result, the mutual interference between the protruding piece and the engaging jaw portion becomes excessively small, and this causes the following problems. That is, (1) there is a tendency that the tip end of the protruding piece is once positioned above the engaging jaw portion, and then, the tip end of the protruding piece accidentally returns to the position below the engaging jaw portion, so that the body may not be kept at the required opening position; and (2) the sound generated at the time the protruding piece passes elastically over the engaging jaw portion is unsatisfactory, so that the consumer sometimes cannot recognize that the body has been pivoted to the required opening position.

For solving the problems, the present invention aims to provide a novel and improved container closure. According to the present invention, once the body detached from the mouth-and-neck portion is pivoted to a required opening position, the body can be kept at the opening position with a sufficient reliability even if the container closure has a relatively short axial length. Further, when the body is pivoted to the opening position, a sound sufficiently recognizable for the consumer is generated reliably.

Means for Solving the Problems

As a result of keen studies, the present inventors have found that the main object in the technical field can be achieved by forming an extending portion in the engaging piece. The extending portion is positioned between the engaging jaw portion of the mouth-and-neck portion and the tamper evident skirt portion at least in the angle region in which the protruding piece is present in a state where the container closure of synthetic resin is mounted on the mouth-and-neck portion.

That is, the present invention provides a container closure of synthetic resin to be applied to a container. The container has an external thread and an engaging jaw portion positioned below the external thread formed on the outer periphery of the mouth-and-neck portion. The container closure of synthetic resin comprises:

a body having a top panel wall and a cylindrical skirt wall extending perpendicularly downward from the peripheral edge of the top panel wall, and an internal thread disposed on the inner periphery of the skirt wall so as to be screwed to the external thread, and;

a cylindrical tamper evident skirt portion connected to the skirt wall of the body via a plurality of breakable bridge portions disposed circumferentially with spacing, the tamper evident skirt portion has an engaging means disposed on the inner periphery of the tamper evident skirt portion so as to engage with the engaging jaw portion;

the engaging means is formed of: either a plurality of engaging pieces disposed circumferentially with spacing and extending upward and radially inward from the base end connected to the tamper evident skirt portion, or an annular engaging piece extending in a circumferentially continuous manner and extending upward and radially inward from the base end connected to the tamper evident skirt portion, and protruding pieces that protrude downward are disposed at the skirt wall of the body, and unbroken connecting pieces that connect the skirt wall of the body to the tamper evident skirt portion and that allow the body to ascend relative to the tamper evident skirt portion are disposed, wherein extending portions that extend upward are formed at the tip ends of the engaging pieces in at least an angle region in which the protruding pieces are present, and the extending portions formed in the angle region in which the protruding pieces are present are to be positioned between the engaging jaw portion of the mouth-and-neck portion and the protruding pieces in a state where the container closure of synthetic resin is mounted on the mouth-and-neck portion.

Preferably, an engaging protrusion is formed on the radially inner side face of the engaging piece, and the engaging protrusion is to protrude radially inward below the engaging jaw portion in a state where the container closure of synthetic resin is mounted on the mouth-and-neck portion. Suitably, an additional extending portion is formed in a region other than the angle region in which the protruding piece is present. Desirably, the engaging means comprises a plurality of engaging pieces disposed circumferentially with spacing and extending upward and radially inward from a base end connected to the tamper evident skirt portion, and the extending portions are formed on both circumferential side faces of each of the engaging pieces. Suitably, the radially outer side face of each of the extending portions gradually protrudes radially outward when viewed from below, and then, gradually recedes radially inward when viewed from below. Further suitably, a site on the radially outer side face of each of the extending portions, which gradually protrudes radially outward when viewed from below, is arc-shaped in the longitudinal cross section, and a site that gradually recedes radially inward when viewed from below is linear in the longitudinal cross section.

Effects of the Invention

The container closure of the present invention has an engaging piece having an extending portion formed in an angle region in which a protruding piece is present. The extending portion is positioned between the engaging jaw portion of the mouth-and-neck portion and the tamper evident skirt portion in a state where the container closure of synthetic resin is mounted on the mouth-and-neck portion. When the body detached from the mouth-and-neck portion is pivoted in the direction to be separated from the mouth-and-neck portion, the tip end of the protruding piece is required to pass elastically over the extending portion positioned in the radial outside together with the engaging jaw portion of the mouth-and-neck portion, and the tip end of the protruding piece is interfered by the extending portion. Even when the container closure has a relatively short axial length, the interference of the tip end of the protruding piece and the extending portion does not become considerably small. This can prevent sufficiently reliably the aforementioned problems. Specifically, the tip end of the protruding piece, which is once positioned above the engaging jaw portion, never returns accidentally to the position below the engaging jaw portion. As a result, the container closure is kept sufficiently reliably at the required opening position. Furthermore, when the protruding piece passes elastically over the extending portion, a sound recognizable for a consumer is reliably generated.

MODE FOR CARRYING OUT THE INVENTION

A preferred embodiment of a container closure of synthetic resin constituted in accordance with the present invention will now be described in further detail with reference to the attached drawings.

Figure 1:
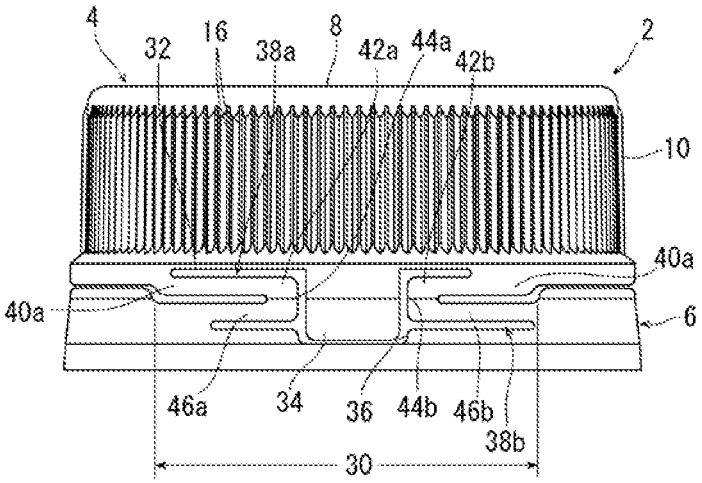
FIG. 1 is a front view showing a preferred embodiment of a container closure constituted in accordance with the present invention.
Figure 2:
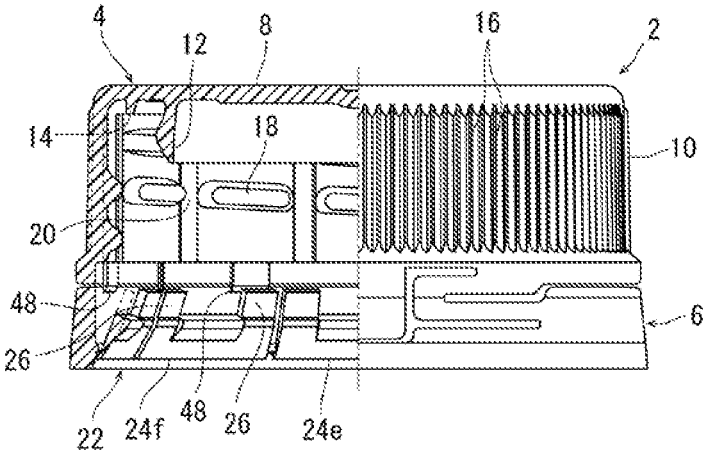
FIG. 2 is a front view showing, partly in cross section, the container closure shown in FIG. 1.
Figure 3:
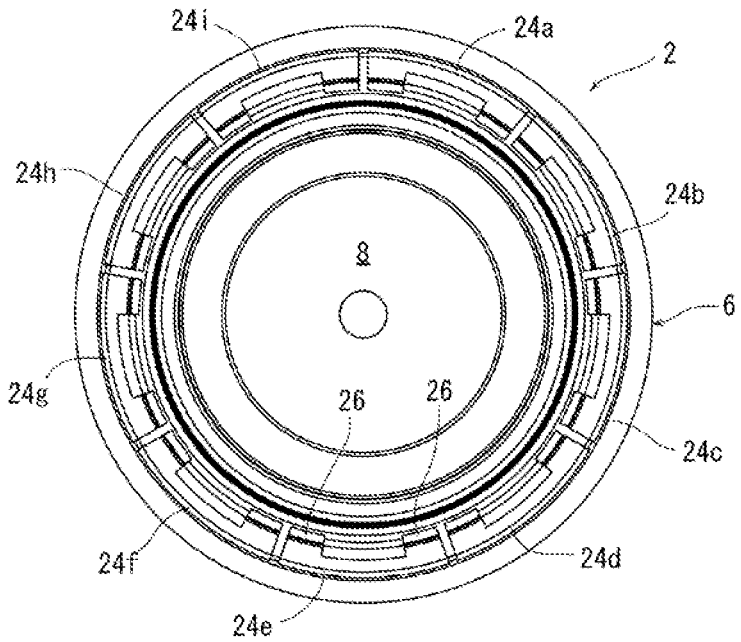
FIG. 3 is a bottom view of the container closure shown in FIG. 1.

The container closure of synthetic resin constituted according to the present invention will be described below with reference to FIGS. 1-3 illustrating a suitable embodiment. It is advantageous that the container closure of synthetic resin indicated as a whole with the numeral 2 can be integrally molded from any suitable synthetic resin such as polyethylene or polypropylene by injection molding or compression molding. The container closure 2 includes a body 4 and a tamper evident skirt portion 6. The body 4 has a circular top panel wall 8, and a cylindrical skirt wall 10 extending perpendicularly downward from the peripheral edge of the top panel wall 8. Two sealing ridges, namely, an inner annular ridge 12 and an outer annular ridge 14 are formed on the inner surface of the top panel wall 8. On the outer periphery of the skirt wall 10, an asperity 16 is formed repeatedly for preventing slipping of fingers hooked thereto. An internal thread 18 is formed on the inner periphery of the skirt wall 10. In the internal thread 18, notches 20 are formed with spacing in the circumferential direction. The tamper evident skirt portion 6 is shaped cylindrically as a whole, and it is connected to the skirt wall 10 of the body 4 via a breakable bridge portion and a pair of unbroken connecting pieces, both of which will be mentioned below. On the inner periphery of the tamper evident skirt portion 6, an engaging means 22 is disposed. The engaging means 22 in the illustrated embodiment is composed of nine arc-shaped engaging pieces 24*a*-24*i* formed circumferentially with spacing. Each of the arc-shaped engaging pieces 24*a*-24*i* extends from the base end connected to the inner periphery of the tamper evident skirt portion 6, axially upward and radially inward. Although the engaging means 22 is composed of nine arc-shaped engaging pieces 24*a*-24*i* disposed circumferentially with spacing in the embodiment illustrated in the attached drawings, as required, it can be composed of an annular engaging piece that is provided continuously in a circumferentially extended manner and extending axially upward and radially inward from the base end connected to the inner periphery of the tamper evident skirt portion 6.

It is important for the container closure 2 constituted according to the present invention that an extending portion 26 extending from the tip end of each of the engaging pieces 24*a*-24*i* is formed at least in the region in which the below-mentioned protruding piece 34 is formed. In the illustrated embodiment, at each of the engaging pieces 24*a*-24*i*, two rectangular extending portions 26 extending from both circumferential sides are formed. As clearly understandable with reference to FIG. 8 along with FIGS. 2 and 3, it is preferable that each of the radial outer side face of the extending portion 26 gradually protrudes radially outward when viewed from below, and then, it gradually recedes radially inward when viewed from below. It is further preferable that a site 26*a*, which protrudes gradually radially outward when viewed from below, is arc-shaped in its longitudinal cross section, and that a site 26*b*, which gradually recedes radially inward when viewed from below, is linear in its longitudinal cross section from the viewpoint that the protruding piece 34 cooperates with the site 26*b* to reliably keep the container closure 2 at the required opening position as further mentioned below. Each of the radially inner side faces of the extending portion 26 may be flat. It is desirable that an engaging protrusion 28 that protrudes radially inward is formed on the radially inner side face of the major part of each of the engaging pieces 24*a*-24*i*, i.e., the radially inner side faces of the sites except for the extending portion 26. The engaging protrusion 28 gradually protrudes further when viewed from below, and its upper surface is in a state extending in a substantially horizontal manner. Each of the engaging protrusions 28 is formed at the circumferential center of each of the engaging pieces 24*a*-24*i*, namely, the region other than the extending portion 26. As required, the engaging protrusion 28 can be formed in the circumferential direction over the entire surface of each of the engaging pieces 24*a*-24*i*.

A further explanation will be made with reference to FIGS. 1-3. In a specific region indicated with the reference numeral 30, the lower edge of the skirt wall 10 of the body 4 is displaced higher than the lower edge in other region. The upper edge of the tamper evident skirt portion 6 is displaced lower than the upper edge in other region. Between the skirt wall 10 and the tamper evident skirt portion 6, an opening 32 that extends laterally in the front view is formed. In the circumferential center of the opening 32, a substantially rectangular protruding piece 34 is formed on the skirt wall 10 to protrude downward from the lower edge of the skirt wall 10. As clearly understandable with reference to FIG. 8 along with FIG. 1, the protruding piece 34 extends downward substantially perpendicularly. Corresponding to the protruding piece 34, a notch 36 with an upward opening is formed at the tamper evident skirt portion 6 in order to receive the protruding end portion of the protruding piece 34.

As clearly illustrated in FIGS. 1 and 2, in the specific region 30, a pair of unbroken connecting pieces 38*a* and 38*b* are disposed on both circumferential sides adjacent to the protruding piece 34. The unbroken connecting piece 38*a* in the illustrated embodiment comprises: an upper end portion 40*a* connected to the lower edge of the skirt wall 10; a first tiltable portion 42*a* that extends substantially horizontally in one circumferential direction (to the right in FIGS. 1 and 2) following the upper end portion 40*a*; a middle portion 44*a*; and a second tiltable portion 46*a* that extends substantially horizontally in the opposite circumferential direction (to the left in FIGS. 1 and 2) below the first tiltable portion 42*a* following the middle portion 44*a*, thereby being connected to the tamper evident skirt portion 6. Similarly, the unbroken connecting piece 38*b* comprises: an upper end portion 40*b* connected to the lower edge of the skirt wall 10; a first tiltable portion 42*b* that extends substantially horizontally in one circumferential direction (to the left in FIGS. 1 and 2) following the upper end portion 40*b*; a middle portion 44*b*; and a second tiltable portion 46*b* that extends substantially horizontally below the first tiltable portion 42*b* following the middle portion 44*b* in the opposite circumferential direction (to the right in FIGS. 1 and 2), thereby being connected to the tamper evident skirt portion 6. As required, it is also possible to incline the first tiltable portion 42*a* and the second tiltable portion 46*a* of the unbroken connecting piece 38*a* and the first tiltable portion 42*b* and the second tiltable portion 46*b* of the unbroken connecting piece 38*b* in a predetermined direction not in the substantially horizontal direction. As clearly understandable with reference to FIG. 1, the unbroken connecting piece 38*a* and the unbroken connecting piece 33*b* are not axisymmetric but the circumferential dimensions of these components are somewhat different from each other (see Patent Document 2 for the reason).

The specific region indicated with the reference numeral 30 is the region in which the protruding piece 34 and the pair of unbroken connecting pieces 38*a* and 38*b* are present. In the remaining region other than the specific region 30, a plurality of breakable bridge portions 48 to connect the tamper evident skirt portion 6 to the lower end of the skirt wall 10 of the body 4 are disposed circumferentially with spacing. In the illustrated embodiment, six narrow ridges are formed circumferentially with spacing, and these ridges extend axially over the inner surface of the skirt wall. 10 and the inner surface of the tamper evident skirt portion 6. A part of each of the narrow ridges, which is positioned between the skirt wall 10 and the tamper evident skirt portion 6, forms a breakable bridge portion 48 (see FIG. 2). As required, the breakable bridge portion can be disposed also in the region in which the pair of unbroken connecting pieces 36*a* and 38*b* are present. For instance, the breakable bridge portion can be disposed between the first tiltable portions 42*a*, 42*b* and the skirt wall 10, between the second tiltable portions 46*a*, 46*b* and the tamper evident skirt portion 6, or between the protruding piece 34 and the tamper evident skirt portion 6.

Figure 4:
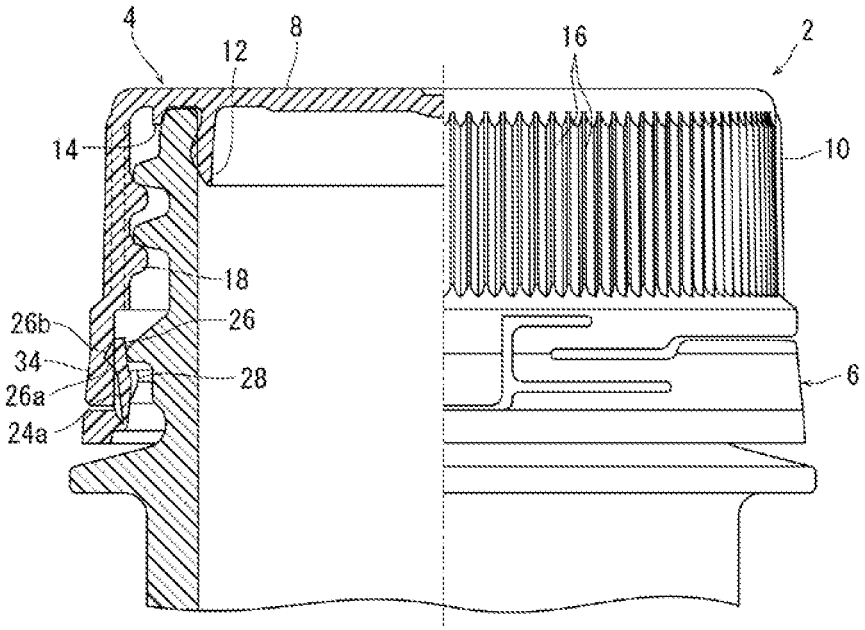
FIG. 4 is a front view showing, partly in cross section, the container closure shown in FIG. 1, in a state mounted on a mouth-and-neck portion of a container.

FIG. 4 shows a mouth-and-neck portion 50 of a container with the container closure 2 mounted thereon. The mouth-and-neck portion 50 of the container, which can be formed from any suitable synthetic resin such as polyethylene terephthalate or from glass, has a cylindrical shape as a whole, and its upper surface is open. An external thread 52 and an engaging jaw portion 54 positioned below the external thread 52 are formed on the outer periphery of the mouth-and-neck portion 50.

In mounting the container closure 2 on the mouth-and-neck portion 50 to seal the mouth-and-neck portion 50, the container closure 2 is fitted on the mouth-and-neck portion 50 and rotated in a closing direction (clockwise when viewed from above in FIG. 4) to screw the internal thread 18 of the container closure 2 to the external thread 52 of the mouth-and-neck portion 50. As the screwing of the internal thread 18 to the external thread 52 proceeds, the container closure 2 gradually descends relative to the mouth-and-neck portion 50. After the container closure 2 descends relative to the mouth-and-neck portion 50 to a state as shown in FIG. 4, the inner annular ridge 12 and the outer annular ridge 14 formed on the inner surface of the top panel wall 8 in the body 4 of the container closure 2 are brought into intimate contact with the inner periphery and the outer periphery of the mouth-and-neck portion 50, whereby the mouth-and-neck portion 50 is sealed. The major part of each of the engaging pieces 24*a*-24*i* is disposed on the inner periphery of the tamper evident skirt portion 6 of the container closure 2. Here, the major part indicates the region of the engaging piece other than the extending portion 26. The major part is deformed elastically to be positioned below the engaging jaw portion 54 of the mouth-and-neck portion 50, while the upper surface of the engaging protrusion 28 formed on the radially inner surface is positioned to face the lower surface of the engaging jaw portion 54. Meanwhile, one side portion of the extending portion 26 in each of the engaging pieces 24*a* and 24*i* (as for the engaging piece 24*a*, left side in FIG. 3; as for the engaging piece 24*i*, right side in FIG. 3) is positioned between the protruding piece 34 of the body 4 and the engaging jaw portion 54 of the mouth-and-neck portion 50, and is positioned between the inner periphery of the protruding piece 34 and the outer periphery of the engaging jaw portion 54.

Figure 5:
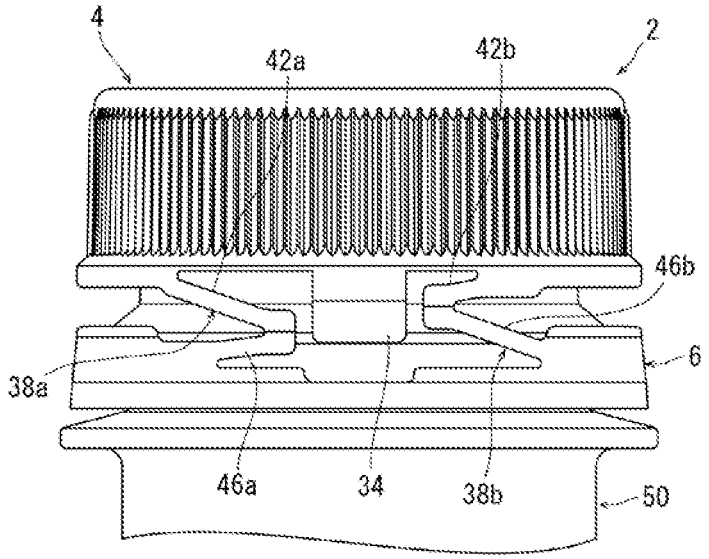
FIG. 5 is a front view showing the body of the container closure shown in FIG. 1, during an unsealing operation of rotating the body in the opening direction for detaching the body from the mouth-and-neck portion of the container.

In unsealing the mouth-and-neck portion 50, the container closure 2 is rotated in the opening direction (counterclockwise when viewed from above in FIG. 4) to gradually release the screwing of the internal thread 18 of the container closure 2 to the external thread 52 of the mouth-and-neck portion 50. Upon gradually releasing the screwing, the body 4 of the container closure 2 is rotated in the opening direction and also allowed to ascend. On the other hand, the tamper evident skirt portion 6 is inhibited from ascending, because the upper surfaces of the engaging protrusions 28 of the engaging pieces 24*a*-24*i* are in engagement with the lower surface of the engaging jaw portion 54 of the mouth-and-neck portion 50. As a result, the breakable bridge portions 48 is applied with a considerable stress to be broken. Then, the body 4 of the container closure 2 ascends simultaneously with its rotation in the opening direction, and is gradually spaced upward from the tamper evident skirt portion 6. As will be clearly understandable with reference to FIG. 5 along with FIG. 4, when the body 4 is gradually spaced upward from the tamper evident skirt portion 6, the first tiltable portion 42*a* of the unbroken connecting piece 38*a* and the second tiltable portion 46*b* of the unbroken connecting piece 38*b* are pivoted clockwise, that is, tilted clockwise in FIGS. 4 and 5, about the lower end of the middle portion 44*a* and the lower end of the second tiltable portion 46*b*, whereas the second tiltable piece 46*a* of the unbroken connecting piece 38*a* and the first tiltable portion 42*b* of the unbroken connecting piece 38*b* are pivoted counterclockwise, that is, tilted counterclockwise in FIGS. 4 and 5, about the lower end of the second tiltable portion 46*a* and the upper end of the first tiltable portion 42*b*, respectively. In accordance with these motions, inclination angles of the first tiltable portions 42*a* and 42*b* and the second tiltable portions 46*a* and 46*b* of the unbroken connecting pieces 36*a* and 38*b* relative to the vertical line are decreased gradually. As will be clearly understandable with reference to FIG. 6 along with FIGS. 4 and 5, when the screwing of the internal thread 18 of the container closure 2 to the external thread 54 of the mouth-and-neck portion 50 is completely released, the body 4 of the container closure 2 is detached from the mouth-and-neck portion 50. However, since the body 4 is still connected via the unbroken connecting pieces 38*a* and 38*b* to the tamper evident skirt portion 6 continuously mounted on the mouth-and-neck portion 50, the body 4 will not be spaced from the mouth-and-neck portion 50 of the container.

Figure 6:
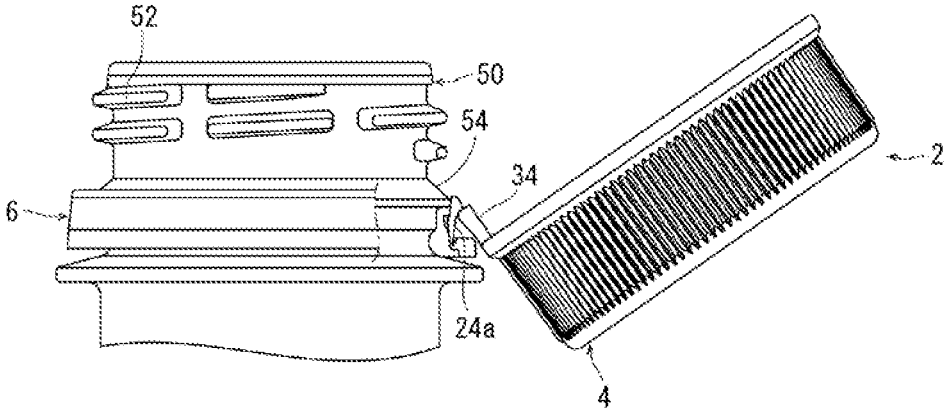
FIG. 6 is a side view of the container closure of FIG. 1, which is partially cut away to show a slightly pivoted state in the direction after detachment from the mouth-and-neck portion so as to be distanced from the mouth-and-neck portion.

After the body 4 of the container closure 2 is detached from the mouth-and-neck portion 50, the body 4 is pivoted about the middle portions 44*a* and 44*b* of the unbroken connecting pieces 38*a* and 38*b* as hinge fulcrums, away from the mouth-and-neck portion 50 (clockwise in FIG. 6).

Figure 7:
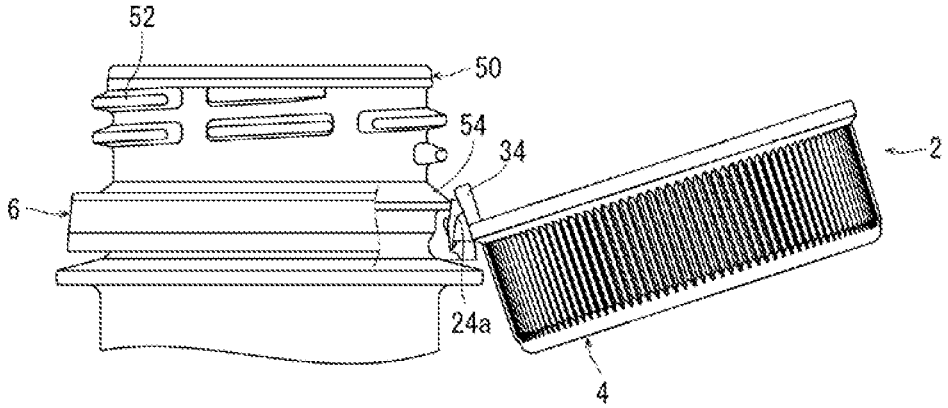
FIG. 7 is a side view showing, partly in cross section, the body of the container closure shown in FIG. 1, which is detached from the mouth-and-neck portion of the container and pivoted to a predetermined opening position in a direction to be distanced from the mouth-and-neck portion.
Figure 8:
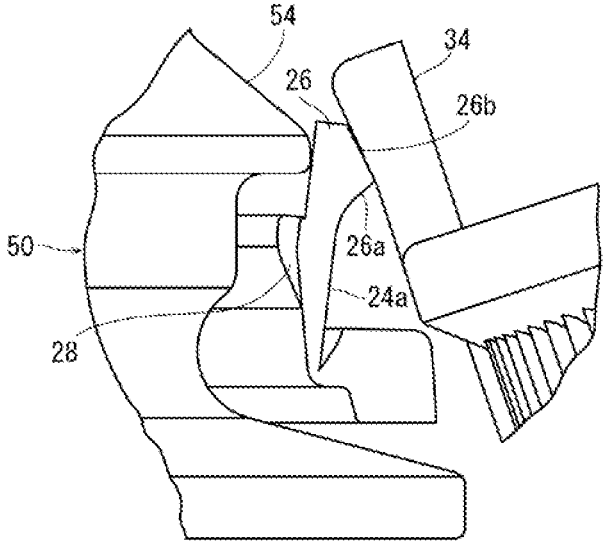
FIG. 8 is a magnified view showing the vicinity of the protruding piece shown in FIG. 7.

At this time, as shown in FIG. 6, the extending end of the protruding piece 34 is brought into contact with one of the side portions of each of the engaging pieces 24*a* and 24*i* (as for the engaging piece 24*a*, left side in FIG. 3; as for the engaging piece 24*i*, right side in FIG. 3), and it deforms elastically to ascend along the outer side faces of the engaging pieces 24*a* and 24*i*, and then, ascends along the arc-shaped site 26*a* on the outer side face of the extending portion 26 of each of the engaging pieces 24*a* and 24*i* (as for the engaging piece 24*a*, the extending portion 1') 26 at the left side in FIG. 3; as for the engaging piece 24*i*, the extending portion 26 at the right side in FIG. 3). Later, the protruding piece 34 passes over the arc-shaped site 26*a* of the extending portion 26, and as illustrated in FIGS. 7 and 8, it is restored elastically so that the outer side face is brought into surface-contact with the linear site 26*b* of the extending portion 26. In this manner, the body 4 of the container closure 2 can be held reliably at the opening position shown in FIGS. 7 and 3. When the protruding piece 34 passes over the arc-shaped site 26*a* of the extending portion 26 so as to be elastically restored, a sound is generated. In the container closure 2 constituted according to the present invention, the protruding piece 34 of the body 4 acts directly not on the engaging jaw portion 54 of the mouth-and-neck portion 50, but on the extending portions 26 of the engaging pieces 24*a* and 24*i* positioned outside the engaging jaw portion 54 of the mouth-and-neck portion 50, and thus, the body 4 pivoted to the opening position is held reliably at the opening position. The protruding piece 34 will not accidentally pass over the linear site 26*b* of the extending portion 26 to cause the body 4 to be pivoted counterclockwise in FIGS. 7 and 6. When the protruding piece 34 passes over the arc-shaped site 26*a* of the extending portion 26 so as to be elastically restored, a sound that is sufficiently loud for a consumer to recognize is generated.

In a case where eating or drinking of the contents is interrupted, the body 4 held at the position shown in FIG. 7 is forcibly pivoted in the direction to approach the mouth-and-neck portion 50 (counterclockwise in FIGS. 6 and 7) and fitted again onto the mouth-and-neck portion 50. Then, the container closure 2 is rotated in the closing direction to screw the internal thread 18 of the container closure 2 to the external thread 52 of the mouth-and-neck portion 50. In this manner, the container closure 2 is positioned again in the state shown in FIG. 4, whereby the mouth-and-neck portion 50 can be temporarily sealed.

The description above refers to preferred embodiments for the container closure constituted in accordance with the present invention with reference to the attached drawings. The present invention is not limited to these embodiments but various modification is possible without departing from the scope of the present invention. For instance, in the embodiments illustrated in the drawings, the extending portions 26 are formed on the both circumferential sides of each of the engaging pieces 24*a*-24*i*. Alternatively, it is possible to form one extending portion or three or more extending portions at any suitable site(s) (e.g., the center or plural sites with circumferential spacing) of each of the engaging pieces 24*a*-24*i*. As required, it is possible to form one extending portion having a width substantially identical to the circumferential width of the engaging pieces 24*a*-24*i*. While the extending portions 26 are formed at the respective engaging pieces 24*a*-24*i* in the embodiments illustrated in the attached drawings, as required, the extending portions can be formed only at predetermined engaging pieces or some engaging pieces disposed in the angle region in which the protruding piece 34 is present. Further, in the embodiments illustrated in the attached drawings, two engaging pieces 24*a* and 24*i* are present in the angle region in which the protruding piece 34 is present. It is also possible to provide only one engaging piece in the angle region in which the protruding piece 34 is present and to form the extending portion at only the single engaging piece. In a case of an annular engaging piece that extends continuously in the circumferential direction, at least one extending portion may be formed in the angle region in which the protruding piece 34 is present. Furthermore, a plurality of extending portions may be formed circumferentially with spacing in the remaining region other than the angle region in which the protruding piece 34 is present. Alternatively, it is possible to form an annular extending portion that is present circumferentially in a continuously extended manner. Although the protruding piece 34 is composed of a single piece in the illustrated embodiment, it is possible to form the protruding piece of a plurality of pieces. Alternatively, at least one slit extending from the protruding end (lower end) to the base end (upper end) of a single piece can be formed to divide the piece into a plurality of parts. In the illustrated embodiment, two unbroken connecting pieces 38*a* and 38*b* are disposed on the circumferential both sides of the protruding piece 34. This example is not limitative but one unbroken connecting piece or at least three unbroken connecting pieces can be disposed.

EXPLANATIONS OF LETTERS OR NUMERALS

2: Container closure
4: Body
6: Tamper evident skirt portion
8: Top panel wall
10: Skirt wall
18: Internal thread
22: Engaging means
24*a*: Engaging piece
24*b*: Engaging piece
24*c*: Engaging piece
24*d*: Engaging piece
24*e*: Engaging piece
24*f*: Engaging piece
24*g*: Engaging piece
24*h*: Engaging piece
24*i*: Engaging piece
26: Extending portion
34: Protruding piece
38*a*: Unbroken connecting piece
38*b*: Unbroken connecting piece
48: Breakable bridge portion
50: Mouth-and-neck portion
52: External thread
54: Engaging jaw portion

The invention claimed is:

1. A container closure of synthetic resin configured to be applied to a container having an external thread and an engaging jaw portion positioned below the external thread on an outer periphery of the mouth-and-neck portion, the container closure comprising:

a body having a top panel wall and a cylindrical skirt wall extending perpendicularly downward from a peripheral edge of the top panel wall, and an internal thread on an inner periphery of the cylindrical skirt wall which is configured to be screwed to the external thread of the container;

a cylindrical tamper evident skirt portion connected to the cylindrical skirt wall of the body via breakable bridge portions disposed circumferentially with spacing therebetween;

engaging pieces configured to engage with the engaging jaw portion of the container, the engaging pieces being disposed circumferentially with spacing therebetween on an inner periphery of the cylindrical tamper evident skirt portion, and extending upward and radially inward from a base end connected to the cylindrical tamper evident skirt portion;

protruding pieces that protrude downward, the protruding pieces being at the cylindrical skirt wall of the body;

unbroken connecting pieces that connect the cylindrical skirt wall of the body to the cylindrical tamper evident skirt portion, the unbroken connecting pieces being configured to allow the body to ascend relative to the cylindrical tamper evident skirt portion; and extending portions that extend upward and are at tip ends of the engaging pieces in at least an angle region in which the protruding pieces are present, and the extending portions are configured to be positioned between the engaging jaw portion of the mouth-and-neck portion of the container and the protruding pieces in a state in which the container closure is mounted on the mouth-and-neck portion of the container, wherein a radially outer side face of each of the extending portions protrudes radially outward when viewed from below and then recedes radially inward when viewed from below.

2. The container closure according to claim 1, further comprising an engaging protrusion on a radially inner side face of each of the engaging pieces, the engaging protrusion being configured to protrude radially inward below the engaging jaw portion of the container in the state in which the container closure is mounted on the mouth-and-neck portion of the container.

3. The container closure according to claim 1, wherein an additional extending portion is defined in a region other than the angle region in which the protruding pieces are present.

4. The container closure according to claim 1, wherein the extending portions are on both circumferential side faces of each of the engaging pieces.

5. The container closure according to claim 1, wherein a first site on the radially outer side face of each of the extending portions, which protrudes radially outward when viewed from below, is arc-shaped in a longitudinal cross section, and a second site that recedes radially inward when viewed from below is linear in a longitudinal cross section.

6. A container closure of synthetic resin configured to be applied to a container having an external thread and an engaging jaw portion positioned below the external thread on an outer periphery of the mouth-and-neck portion, the container closure comprising:

a body having a top panel wall and a cylindrical skirt wall extending perpendicularly downward from a peripheral edge of the top panel wall, and an internal thread on an inner periphery of the cylindrical skirt wall which is configured to be screwed to the external thread of the container;

a cylindrical tamper evident skirt portion connected to the cylindrical skirt wall of the body via breakable bridge portions disposed circumferentially with spacing therebetween;

an annular engaging piece configured to engage with the engaging jaw portion of the container, the annular engaging piece extending circumferentially continuously, and extending upward and radially inward from a base end connected to the cylindrical tamper evident skirt portion;

protruding pieces that protrude downward, the protruding pieces being at the cylindrical skirt wall of the body;

unbroken connecting pieces that connect the cylindrical skirt wall of the body to the cylindrical tamper evident skirt portion, the unbroken connecting pieces being configured to allow the body to ascend relative to the cylindrical tamper evident skirt portion; and extending portions that extend upward and are at a tip end of the annular engaging piece in at least an angle region in which the protruding pieces are present, and the extending portions are configured to be positioned between the engaging jaw portion of the mouth-and-neck portion of the container and the protruding pieces in a state in which the container closure is mounted on the mouth-and-neck portion of the container, wherein a radially outer side face of each of the extending portions protrudes radially outward when viewed from below and then recedes radially inward when viewed from below.

7. The container closure according to claim 6, further comprising an engaging protrusion on a radially inner side face of the annular engaging piece, the engaging protrusion being configured to protrude radially inward below the engaging jaw portion of the container in the state in which the container closure is mounted on the mouth-and-neck portion of the container.

8. The container closure according to claim 6, wherein an additional extending portion is defined in a region other than the angle region in which the protruding pieces are present.

9. The container closure according to claim 6, wherein a first site on the radially outer side face of each of the extending portions, which protrudes radially outward when viewed from below, is arc-shaped in a longitudinal cross section, and a second site that recedes radially inward when viewed from below is linear in a longitudinal cross section.

* * * * *